United States Patent [19]

Woodard

[11] Patent Number: 5,063,276

[45] Date of Patent: Nov. 5, 1991

[54] PUSHBUTTON SWITCH WITH ROTATIONAL CONTACT WIPING ACTION

[75] Inventor: Tony O. Woodard, Pine Level, N.C.

[73] Assignee: Eaton Corporation, Cleveland, Ohio

[21] Appl. No.: 570,447

[22] Filed: Aug. 20, 1990

[51] Int. Cl.[5] ..... H01H 3/02; H01H 13/14; H01H 1/36

[52] U.S. Cl. ..... 200/529; 200/530; 200/534; 200/536; 200/241

[58] Field of Search ..... 200/529, 530, 534, 536, 200/241, 242; 74/99 R

[56] References Cited

U.S. PATENT DOCUMENTS

| | | | |
|---|---|---|---|
| 2,065,904 | 12/1936 | Meuer | 200/530 |
| 2,083,118 | 6/1937 | Goldstone . | |
| 2,155,765 | 4/1939 | Meuer . | |
| 2,422,097 | 6/1947 | Hansen . | |
| 2,605,375 | 5/1950 | Ellithorpe . | |
| 3,104,300 | 9/1963 | Hutt | 200/530 |
| 3,539,749 | 11/1970 | MacPheat . | |
| 4,650,935 | 3/1987 | Ootsuka et al. | 200/16 A |

FOREIGN PATENT DOCUMENTS

| | | | |
|---|---|---|---|
| 127138 | 3/1932 | Austria | 200/529 |
| 606191 | 11/1934 | Fed. Rep. of Germany | 200/529 |
| 1011751 | 7/1957 | Fed. Rep. of Germany | 200/529 |
| 280294 | 11/1927 | United Kingdom | 200/241 |

OTHER PUBLICATIONS

IBM Tech. Discl. Bull., vol. 15, No. 1, 6-1972.

*Primary Examiner*—Ernest G. Cusick
*Attorney, Agent, or Firm*—L. G. Vande Zande

[57] ABSTRACT

A plunger axially depressible within a tubular housing against a return spring has a conductive pin contact contained within a helically shaped slot through the plunger to project radially from opposite sides of the plunger. A spring biases the pin toward a first pair of stationary contacts. Depression of the plunger effects abutting engagement of the pin on the stationary contacts and continued depression causes the slot to rotationally wipe the pin on the stationary contacts. A conductive washer is slidably disposed over the plunger, keyed to a helical track on the exterior surface of the plunger to cooperatively abut and subsequently rotationally wipe a second pair of stationary contacts to provide a second pole for the switch.

16 Claims, 2 Drawing Sheets

PUSHBUTTON SWITCH WITH ROTATIONAL CONTACT WIPING ACTION

BACKGROUND OF THE INVENTION

This invention relates to pushbutton electric switches. More particularly, the invention relates to pushbutton electric switches wherein the pushbutton/-plunger are manually depressed to bring butt type contacts into engagement. This type of contact action provides little or no wiping action desirable to keep the contact surface clean and free of foreign matter, e.g. carbon, that may impair normal current flow through the switch.

Pushbutton switches of the aforementioned type are relatively uncomplicated, consisting of a minimal number of parts and relying on predetermined depression of the plunger to achieve desired contact pressure. The plunger operates against a return spring and carries the movable contacts into abutting engagement with stationary contacts upon depression. Continued depression of the plunger subsequent to the abutting engagement effects compression of a contact pressure spring. The amount of compression of the pressure spring and the pressure provided thereby are each a function of plunger travel. Through proper selection of springs and plunger stroke, significant force can be applied to the contacts. However, foreign particles from switch arcing or ingress, accumulating on the contact surface, diminish electrical conduction properties between the contacts regardless of the pressure applied to the contacts. It is therefore advantageous and desirable to impart wiping action between the contacts during switch operation to scrape off any impurities collecting on the contact surface, thereby to provide a clean surface for maximum conduction. Inasmuch as the pushbutton switch is of simple straightforward construction, any mechanism for providing contact wipe should have similar construction.

Examples of obtaining contact wipe in pushbutton or plunger type switches are known in the art. For instance, U.S. Pat. 4,650,935 issued Mar. 17, 1987 to Ootsuka et al discloses a bridging contact carried by the linearly movable carrier of an electromagnetic relay wherein the carrier may be provided with oblique grooves and the bridging contact provided with tabs slidably received in the grooves for effecting lateral displacement of the contact as the carrier is moved relative to the bridging contact following abutting engagement with stationary contacts. The shallow angle of the grooves permissible within the carrier provides little lateral displacement of the bridging contact, particularly when the travel of the contact carrier after engagement of the contacts is shown to be approximately only one-third the length of the oblique grooves. As mentioned, this contact structure is described in conjunction with an electromagnetic relay wherein multiple bridging contacts are provided in the carrier. The contact force applied by springs bearing on the bridging contacts is necessarily limited because the cumulative force of these springs upon compression counteracts the closing force of the electromagnet and must necessarily not exceed the pull-in force thereof.

Another pushbutton switch is shown in U.S. Pat. No. 2,605,375 issued July 29, 1952 to G. S. Ellithorpe. This switch has a movable contact having outwardly projecting wings which engage angled surfaces of stationary contacts to wipe along those surfaces as the plunger is biased to an extended position. Contact pressure in this embodiment is applied by the return spring, such pressure reducing as a function of the extended length of the spring. Therefore, in the extended position of the switch, the pressure applied to the movable contact by the spring is at its minimum value. Second angled surfaces are provided for engagement by the movable contact on the following depression stroke to rotate the movable contact into preferred alignment with the first-mentioned angled surfaces for wiping action on the extending stroke as previously described. In this device, wiping action between the movable and stationary contacts is a direct function of axial travel of the pushbutton/plunger, and rotary movement of the movable contact is solely a by-product of such axial movement of the movable contact along the angled surface of the stationary contact.

U.S. Pat. No. 3,539,749 issued Nov. 10, 1970 to A. M. Macpheat discloses a bridging contact comprising dual contact elements having angular slots respectively reversely oriented. A pin carried by the pushbutton is forced linearly downward within the angular slots, thereby camming the contact elements in opposite lateral directions after the elements engage stationary contacts. A spring housed within a cavity of the pushbutton bears upon the contact elements to be compressed as a function of button travel, thereby applying pressure on the contacts.

U.S. Pat. No. 2,422,097 issued June 10, 1947 to K. H. Hansen discloses a pushbutton switch which shows pins radially projecting into angularly disposed slots in tubular members. However, this structure does not provide rotation of the contacts for contact wipe. The pushbutton is depressible axially and is non-rotatable to force a radially extending pin against an angular slot in a rotatable, but non-axially translatable intermediate member whose rotation then effects axial translation of a non-rotatable contact carrier to move the carrier axially into and out of engagement with stationary contacts without rotation U.S. Pat. No. 2,083,118 issued June 8, 1937 to B. Goldstone shows a pushbutton having a tongue movable in an oblique slot to alternately align the tongue with a non-conductive or a conductive surface of an electrical contact member according to the axial position of the pushbutton. U.S. Pat. No. 2,155,765 issued Apr. 25, 1939 to G. J. Meuer discloses a movable contact pin which is guided for vertical movement within slots in an insulating housing. Vertical movement is effected by translational movement of the pin within a slot in the button actuator which is pivotally depressed. The contact actuation occurring in this switch is strictly abutting action and provides no contact wipe.

SUMMARY OF THE INVENTION

This invention provides a pushbutton switch of the type wherein a plunger is depressed against a return spring to directly carry a movable contact into abutting engagement with stationary contacts, the plunger being capable of continued depression to compress contact pressure springs for increasing the contact pressure as a function of depression of the plunger, and provides such switch with helical guide means interrelating with the movable contacts to effect rotation of the movable contacts on the stationary contacts during the continued depression of the plunger, thereby effecting a rotary wiping action between the contacts. The invention further provides a double pole switch of the aforementioned type, each of the poles providing a rotary wiping action between the movable and stationary contacts upon continued depression of the plunger subsequent to contact abutting engagement.

The switch of this invention, its advantages and features, will become more readily apparent when reading the following description and appended claims in conjunction with the accompanying drawings.

DETAILED DESCRIPTION OF THE PREFERRED EMBODIMENT

Figure 7:
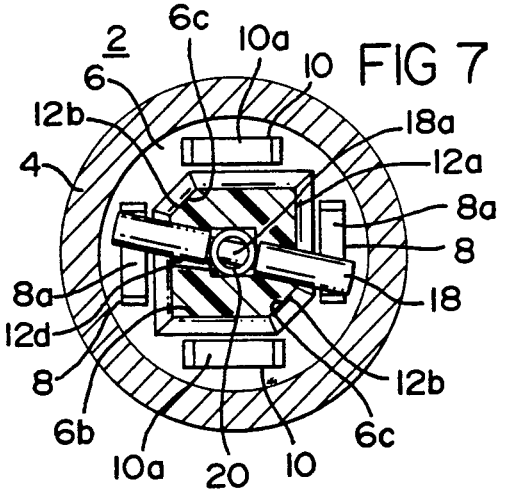
FIG. 7 is a transverse cross section view taken along the line 7—7 in FIG. 5.

The pushbutton switch of this invention is represented in the drawings generally by the numeral 2. It comprises a tubular housing 4 which may be made of metal for enhanced strength and is provided with a threaded bushing 4*a* at one end for mounting the switch to a panel or structural member (not shown). The opposite end of housing 4 has a reduced wall thickness skirt 4*b* depending therefrom which forms, in conjunction with the normal wall thickness of the housing, a rearward facing annular shoulder 4*c* which serves as a seat for an insulating base 6. The base 6 has an annular shoulder 6*a* which seats against shoulder 4*c* and is held firmly thereagainst by spinning over or staking a portion 4*d* of skirt 4*b*. Base 6 has first and second pairs of terminals extending through slots in the base and staked thereto for retention. Terminals 8 are shorter than terminals 10 as can be particularly seen in FIGS. 2 and 3. With reference to FIG. 7, it can be seen that the terminals are arranged in operating pairs at the major orthogonal axes, i.e., they are diametrically opposed and one cooperating pair is angularly displaced 90 degrees from the other cooperating pair. Base 6 is also provided with a square recess 6*b* having angular fillets 6*c* (FIG. 7) at one pair of diagonally opposed corners for reasons that will be described hereinafter. The internal ends of terminals 8 and 10 have essentially flat contact faces 8*a* and 10*a* disposed in planes normal to the axis of tubular housing 4, but in planes that are displaced axially one from another.

Figure 2:
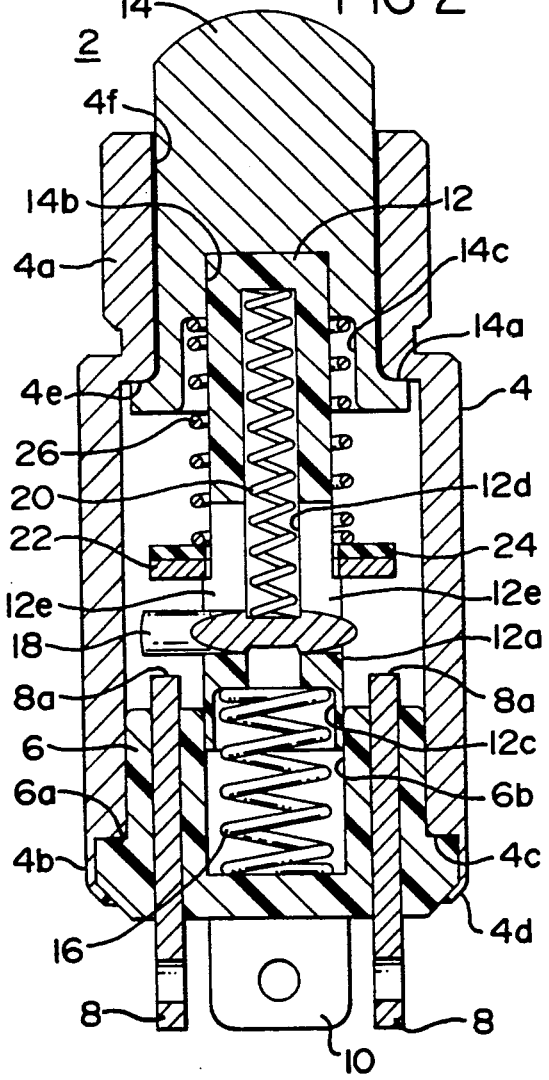
FIG. 2 is a centerline cross sectional view of the switch of this invention taken along the line 2—2 in FIG. 1.
Figure 3:
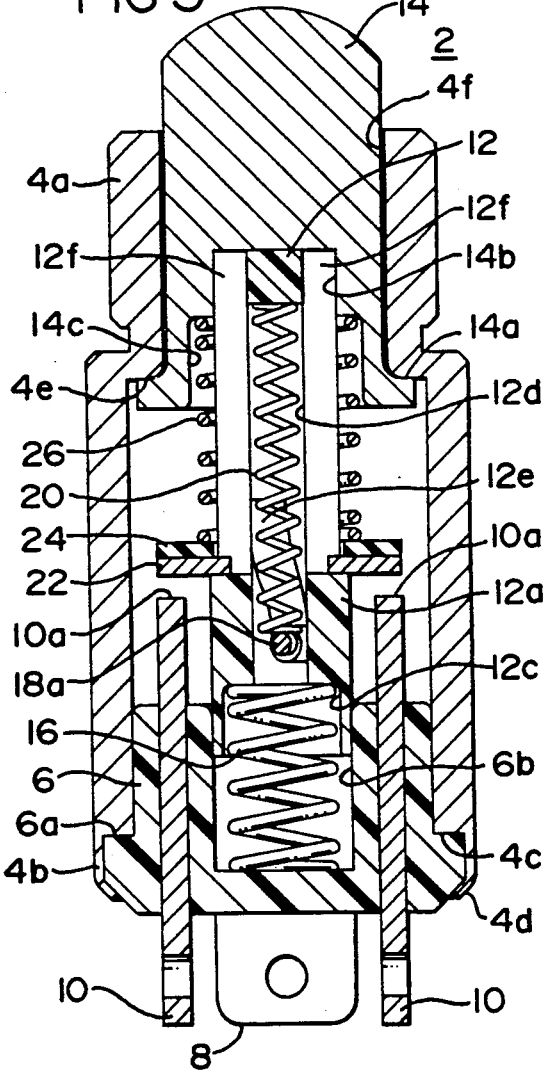
FIG. 3 is a centerline cross sectional view of the switch of this invention taken along the line 3—3 of FIG. 1 which is at right angles to the plane of FIG. 2.

A plunger assembly comprising a molded plastic plunger 12 and a pushbutton 14 (preferably made of metal) is disposed in tubular housing 4 for axial reciprocal movement. With respect to the orientation shown in the drawings, the lower end 12*a* of plunger 12 is square shaped complementally to the recess 6*b*. A pair of diagonally opposite corners are angularly beveled at 12*b* to cooperate with fillets 6*c* for positively rotatably aligning the plunger correctly with respect to the terminals 8 and 10. The square shape of lower end 12*a* and recess 6*b* provides non-rotational keying for the plunger within the housing while permitting axial sliding movement of the plunger. As seen in FIGS. 2 and 3, the lower end of plunger 12 is provided with a circular counterbore 12*c* which serves as a seat for one end of a helical compression spring 16, the other end of which is disposed within recess 6*b*. Spring 16 biases plunger 12 and pushbutton 14 outwardly of the housing to an extended position with respect thereto. Pushbutton 14 has an annular flange 14*a* at its internal end which abuts a reduced diameter shoulder 4*e* created by an opening 4*f* in threaded bushing 4*a* through which the shank of pushbutton 14 extends. The engagement between annular shoulders 14*a* and 4*e* limit outward movement of pushbutton 14 and of plunger 12 which has its upper end firmly biased into a rearwardly opening recess 14*b* in pushbutton 14 by the spring 16. Opening 4*f* is slightly oversize with respect to pushbutton 14 to provide a good sliding bearing surface for the pushbutton.

Figure 1:
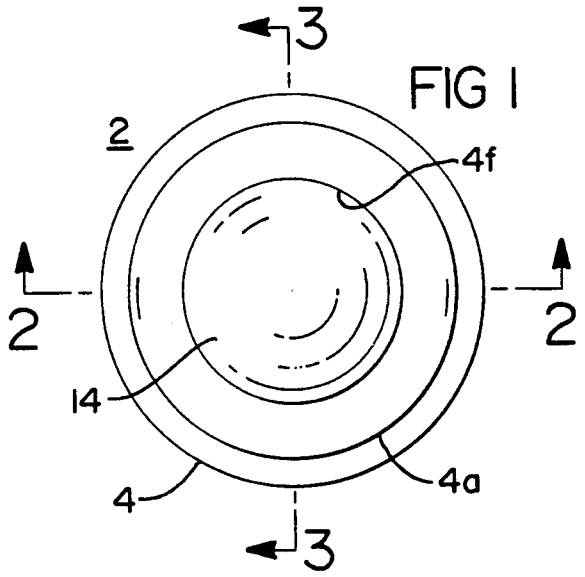
FIG. 1 is an end view of a pushbutton switch constructed in accordance with this invention.
Figure 4:
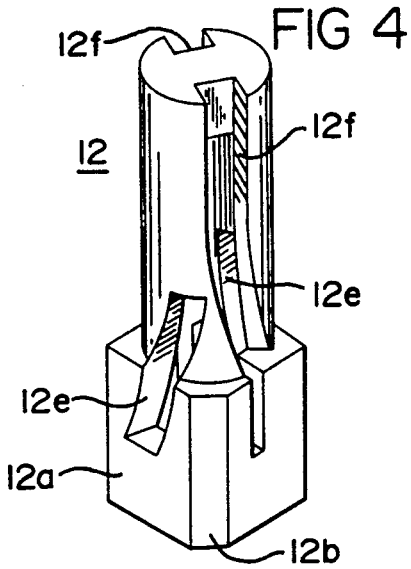
FIG. 4 is an isometric view of the plunger of the switch of this invention.

A blind rectangular hole 12*d* extends axially over the major length of plunger 12, opening to the counterbore 12*c* at the lower end. As best seen in FIG. 4, a helically shaped slot 12*e* is formed in the plunger 12, partly within lower portion 12*a* and partly within a cylindrical upper portion of the plunger. Slot 12*e* extends radially of the axis of plunger 12 and extends completely through the plunger. Due to the helical shape, the angle of slot 12*e* is reversed at opposite sides of plunger 12. A second helical recess is provided in the cylindrical upper end of plunger 12, this recess comprising a pair of diametrically opposed grooves 12*f* formed in the exterior surface of the cylindrical upper end of the plunger. Due to the square shape of hole 12*d* extending over the majority of the length of plunger 12, the wall thickness of the upper portion of plunger 12 becomes relatively thin at certain points. Therefore, the grooves 12*f* preferably comprise a helical slot through the plunger extending from square lower end 12*a* to the upper end of plunger 12. The helical slot forming grooves 12*f* has an axis coincident with the axis of plunger 12. It may be noted particularly in FIG. 4 that the helix of slot 12*e* is angularly reversed to that forming the grooves 12*f*, although they may be angled in the same direction as will be discussed hereinafter.

Figure 8:
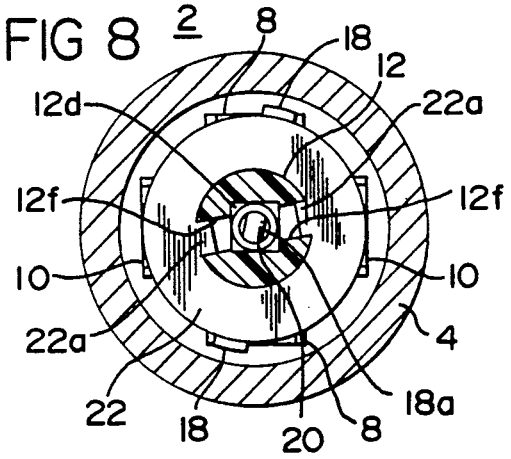
FIG. 8 is a transverse cross section view taken along the line 8—8 in FIG. 6.
Figure 5:
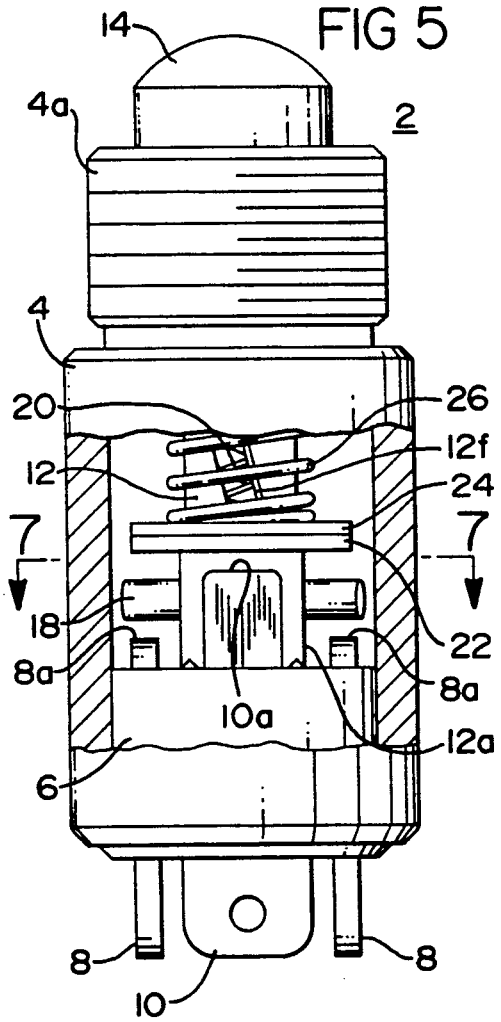
FIG. 5 is a side view of the switch of this invention with a portion of the housing broken away, this view being taken in the same direction as FIG. 2.
Figure 6:
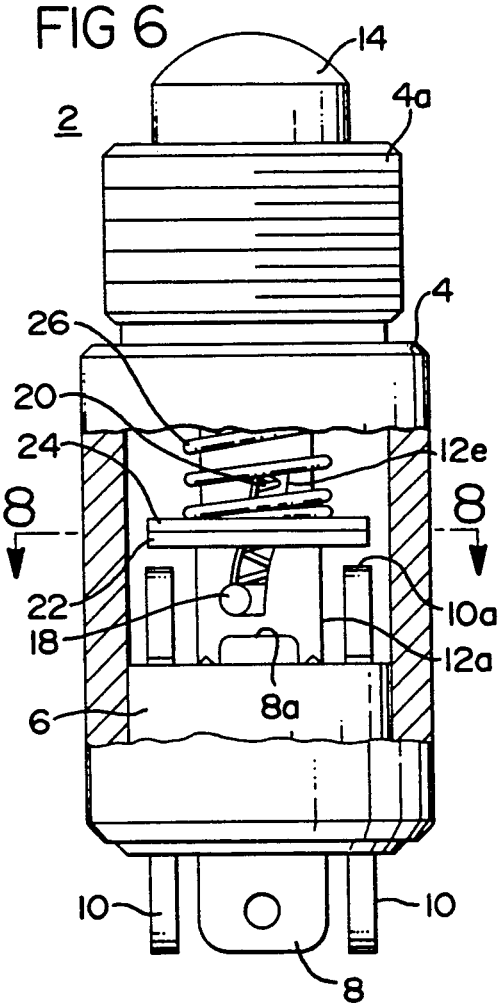
FIG. 6 is a side view of the switch of this invention with a portion of the housing broken away, this view being taken in the same direction as FIG. 3.

A first movable contact member comprising a cylindrical pin 18 is disposed in slot 12*e* such that it extends radially therefrom. Pin 18 has an undercut diameter 18*a* at the center thereof as is best seen in FIGS. 2 and 7. A helical compression spring 20 is disposed within square hole 12*d* to bear between the plunger 12 at the closed upper end of the hole and the movable contact pin 18, seating within the reduced diameter portion 18*a*. Spring 20 biases pin 18 against the lower end of slot 12*e*, toward the stationary contact. A second movable contact 22 comprises a conductive washer slidably disposed over the cylindrical upper end of plunger 12 as best seen in FIG. 8. Washer 22 has a pair of tabs 22*a* extending inwardly in diametrically opposed relation to be slidably disposed within grooves 12*f*. An insulating washer 24 is also slidably disposed over the cylindrical upper end of plunger 12, although the insulating washer 24 is not rotatably keyed to the plunger 14 as is the movable contact 22. A helical compression spring 26 is disposed around the cylindrical upper end of plunger 12 to bear against the insulating washer 24 at one end and seat within a counterbore 14*c* in button 14 at the other end, thereby biasing second movable contact 22 toward the stationary contacts and into engagement with the upper surface of square lower portion 12*a* of the plunger.

In operation, depression of pushbutton 14 directly drives plunger 12 therewith axially within the housing against the bias of spring 16. Depression of plunger 12 carries movable contact pin 18 and washer 22 into substantially simultaneous engagement with the contact surfaces 8*a* of terminals 8 and the contact surfaces 10*a* of terminals 10, respectively. Continued depression of pushbutton 14 and plunger 12 effects axial movement of plunger 12 with respect to the movable contacts 18 and 22, compressing the respective springs 20 and 26 to increase the force applied against the contacts. During such movement, the helical shape of slot 12*e* imparts counterclockwise rotational movement to the pin contact 18 on the contact surfaces 8*a* and the grooves 12*f* impart clockwise rotation to the washer contact 22 on the contact surfaces 10*a* of terminals 10. The helical shape of the slot 12*e* and the grooves 12*f* impart a significant angular rotation to the respective movable contacts as a function of axial translation of the plunger to provide substantial contact wipe. The rotational contact movement and increasing contact pressure create a good wiping action between the stationary and movable contacts to thoroughly clean the contact surfaces and insure good current conduction through the switch.

The switch as hereinabove described provides a double pole device capable of switching DC current loads in excess of 15 amps. It is sufficiently durable to withstand harsh operation. Either movable contact may be omitted to provide a single pole device or one contact may be rearranged to provide one normally closed contact set. Although the second helical guide or track preferably comprises opposed grooves as described hereinabove, it should be recognized that the same could comprise raised ribs on the cylindrical surface of plunger 12 cooperatively intermeshing with diametrically opposed slots on washer 22. It is to be understood that the pushbutton switch of this invention is susceptible of these and various other modifications without departing from the scope of the appended claims.

I claim:

1. A pushbutton switch comprising, in combination:

a housing;

stationary contacts mounted in said housing;

a contact carrier disposed between said stationary contacts reciprocally movable normal to said stationary contacts between ON and OFF positions;

a helically shaped slot extending transversely through said carrier having an axis directed parallel to movement of said carrier;

movable contact means slidably disposed in said slot biased toward said stationary contacts opposite ends of said movable contact means extending beyond said carrier; and said movable contact means being moved into abutting engagement with said stationary contacts and subsequently rotated on said stationary contacts by movement of said carrier to said ON position.

2. A pushbutton switch comprising, in combination:

a housing;

stationary contacts mounted in said housing;

a contact carrier disposed between said stationary contacts reciprocally movable normal to said stationary contacts between ON and OFF positions;

first and second helically shaped recesses in said carrier having respective axes directed parallel to movement of said carrier, said first helically shaped recess comprising a slot through said carrier and said second helically shaped recess comprising grooves in opposite surfaces of said carrier;

movable contact means comprising a first movable contact slidably disposed in said slot having opposite ends extending beyond said carrier and a second movable contact having tabs slidably disposed in said grooves, said first movable contact being axially displaced along said carrier from said second movable contact; and said first and second movable contacts being moved into abutting engagement with respective said stationary contacts and subsequently rotated on said stationary contacts by movement of said carrier to said ON position.

3. The pushbutton switch as defined in claim 2 wherein said stationary contacts comprise first and second diametrically opposed pairs thereof arranged radially about either of said axes, said first pair being angularly and axially displaced with respect to said second pair.

4. The pushbutton switch as defined in claim 3 wherein said first movable contact moves into abutting engagement with said first pair of stationary contacts substantially coincidentally with said second movable contact moving into abutting engagement with said second pair of stationary contacts.

5. The pushbutton switch as defined in claim 2 further comprising an internal cavity in said carrier communicating with said slot, and a spring in said cavity bearing upon said first movable contact to provide said bias toward said stationary contacts.

6. The pushbutton switch as defined in claim 5 wherein said second movable contact is disposed externally on said carrier and said bias toward said stationary contacts is provided by a spring disposed externally on said carrier bearing against said second movable contact.

7. The pushbutton switch as defined in claim 2 wherein said first and second helically shaped recesses are reversely oriented to provide reverse rotation on said stationary contact faces of said first movable contact relative to said second movable contact.

8. A pushbutton switch comprising, in combination:

a housing having an opening therein;

a plunger axially movable in said housing, said plunger comprising a button projecting through said opening in said housing, means non-rotatably keying said plunger to said housing, and helical drive means comprising a helically shaped slot extending transversely through said plunger;

means biasing said plunger to an extended position relative to said housing;

stationary contacts mounted in said housing on diametrically opposite sides of said plunger; and movable contact means comprising a conductive member slidably disposed in said slot for axial movement therein and projecting radially therefrom, said conductive member being moved into abutting engagement with said stationary contact, upon depression of said plunger and subsequently rotated on said stationary contacts by said helical drive means upon continuing depression of said plunger.

9. The pushbutton switch as defined in claim 8 wherein said plunger comprises an axially extending cavity containing a compression spring bearing on said conductive member, biasing said member toward said stationary contacts.

10. A pushbutton switch comprising, in combination:

a housing having an opening therein;

a plunger axially movable in said housing, said plunger comprising a button projecting through said opening in said housing, means non-rotatably keying said plunger to said housing, and helical drive means comprising first and second helical drive means, said first helical drive means comprising a helically shaped slot extending transversely through said plunger, and said second helical drive means comprising a helically shaped track on an exterior surface of said plunger, said slot being axially displaced along said plunger from said track;

means biasing said plunger to an extended position relative to said housing;

stationary contacts mounted in said housing on diametrically opposite sides of said plunger; and movable contact means slidably disposed on said plunger for axial movement thereon and projecting radially therefrom comprising means interrelated with said helical drive means, said movable contact means being moved into abutting engagement with said stationary contact upon depression of said plunger and subsequently rotated on said stationary contacts by said helical drive means upon continuing depression of said plunger.

11. The pushbutton switch as defined in claim 10 wherein said movable contact means comprises a first conductive member disposed in said slot and a second conductive member disposed around said exterior surface.

12. The pushbutton switch as defined in claim 11 wherein said track comprises a pair of helically shaped grooves located at diametrically opposed locations on said exterior surface, and said second conductive member comprises a conductive washer, said interrelated means comprising a pair of radially inwardly directed tabs slidably received in said grooves.

13. The pushbutton switch as defined in claim 12 wherein said stationary contacts comprise pairs of contacts mutually angularly and axially displaced.

14. The pushbutton switch as defined in claim 13 wherein axial displacement of said stationary contacts is substantially the same as said axial displacement of said slot and said track to effect substantially coincident abutting engagement of said first and second movable contacts with respective pairs of stationary contacts upon depression of said plunger.

15. The pushbutton switch as defined in claim 14 wherein said plunger comprises an axially extending cavity containing a compression spring bearing on said first conductive member, biasing said first conductive member toward said stationary contacts, and said second conductive member is biased toward said stationary contacts by a compression spring disposed over said plunger exterior surface, bearing on said second conductive member.

16. The pushbutton switch as defined in claim 11 wherein said helically shaped slot and said helically shaped track are reversely oriented to provide reverse rotation on said stationary contacts of said first conductive member relative to said second conductive member.

* * * * *